US010479952B2

(12) United States Patent
Heise

(10) Patent No.: US 10,479,952 B2
(45) Date of Patent: Nov. 19, 2019

(54) UTILIZATION OF TRANSGENIC HIGH OLEIC SOYBEAN OIL IN INDUSTRIAL APPLICATIONS

(71) Applicant: Monsanto Technology LLC, St. Louis, MO (US)

(72) Inventor: Jerald D. Heise, St. Louis, MO (US)

(73) Assignee: Monsanto Technology LLC, St. Louis, MO (US)

( * ) Notice: Subject to any disclaimer, the term of this patent is extended or adjusted under 35 U.S.C. 154(b) by 0 days.

(21) Appl. No.: 15/308,943

(22) PCT Filed: May 4, 2015

(86) PCT No.: PCT/US2015/028980

§ 371 (c)(1),
(2) Date: Nov. 4, 2016

(87) PCT Pub. No.: WO2015/171472

PCT Pub. Date: Nov. 12, 2015

(65) Prior Publication Data

US 2017/0058226 A1 Mar. 2, 2017

Related U.S. Application Data

(60) Provisional application No. 61/989,259, filed on May 6, 2014.

(51) Int. Cl.
*C10L 1/16* (2006.01)
*C10L 1/18* (2006.01)
(Continued)

(52) U.S. Cl.
CPC ..... *C10L 10/08* (2013.01); *C10L 1/14* (2013.01); *C10L 1/16* (2013.01); *C10L 1/18* (2013.01);
(Continued)

(58) Field of Classification Search
CPC .... C10L 10/08; C10L 1/16; C10L 1/18; C10L 1/1691; C10L 1/1802; C10L 1/1883;
(Continued)

(56) References Cited

U.S. PATENT DOCUMENTS 5,658,864 A 8/1997 Macpherson
5,888,947 A 3/1999 Lambert et al.
(Continued)

FOREIGN PATENT DOCUMENTS

WO 2008/048495 A2 4/2008

OTHER PUBLICATIONS

Erhan, Sevim Z. et al., Oxidation and low temperature stability of vegetable oil-based lubricants, Industrial Crops and Products, vol. 24, No. 3 (2006) pp. 292-299.
(Continued)

*Primary Examiner* — Latosha Hines
(74) *Attorney, Agent, or Firm* — Stinson LLP; Chunping Li

(57) ABSTRACT

Oil compositions derived from transgenic soybeans having a high concentration of oleic acid are described for use in various applications including use to enhance the low temperature pour characteristics of engine fluids. Such oil compositions are useful as lubricants, rail curve grease and engine penetrants.

8 Claims, 3 Drawing Sheets

| | Palmitic | Stearic | Oleic | Linoleic | Linolenic |
|---|---|---|---|---|---|
| Commodity | 11 | 4 | 22 | 55 | 8 |
| VISTIVE GOLD | 3 | 3 | 70 - 75 | 15 | <3 |

(51) Int. Cl.

| | |
|---|---|
| ***C10L 1/14*** | (2006.01) |
| ***C10L 10/08*** | (2006.01) |
| ***C10M 169/04*** | (2006.01) |
| ***C10M 101/04*** | (2006.01) |
| ***C10M 175/00*** | (2006.01) |
| ***F01M 9/04*** | (2006.01) |
| ***F01M 11/04*** | (2006.01) |
| *C10L 1/188* | (2006.01) |
| *C10L 1/19* | (2006.01) |

(52) U.S. Cl.
CPC ..... *C10L 1/1802* (2013.01); *C10M 101/04* (2013.01); *C10M 169/04* (2013.01); *C10M 175/00* (2013.01); *F01M 9/04* (2013.01); *F01M 11/0458* (2013.01); *C10L 1/1616* (2013.01); *C10L 1/1691* (2013.01); *C10L 1/1883* (2013.01); *C10L 1/191* (2013.01); *C10L 1/1905* (2013.01); *C10L 2200/0423* (2013.01); *C10L 2290/24* (2013.01); *C10M 2203/024* (2013.01); *C10M 2203/1006* (2013.01); *C10M 2205/0285* (2013.01); *C10M 2205/16* (2013.01); *C10M 2207/282* (2013.01); *C10M 2207/283* (2013.01); *C10M 2207/2805* (2013.01); *C10M 2207/2835* (2013.01); *C10M 2207/404* (2013.01); *C10M 2207/4045* (2013.01); *C10N 2220/022* (2013.01); *C10N 2220/023* (2013.01); *C10N 2220/10* (2013.01); *C10N 2230/02* (2013.01); *C10N 2230/06* (2013.01); *C10N 2230/10* (2013.01); *C10N 2230/12* (2013.01); *C10N 2240/04* (2013.01); *C10N 2240/08* (2013.01); *C10N 2240/10* (2013.01); *C10N 2240/104* (2013.01); *C10N 2240/401* (2013.01); *C10N 2240/52* (2013.01); *F01M 2011/0475* (2013.01)

(58) Field of Classification Search
CPC ..... C10L 1/14; C10L 1/1616; C10L 1/1905; C10L 1/191; C10L 2200/0423; C10L 2290/24; C10N 2220/022; C10N 2220/023; C10N 2220/10; C10N 2230/02; C10N 2230/06; C10N 2230/10; C10N 2230/12; C10N 2240/08; C10N 2240/10; C10N 2240/52; C10N 2240/104; C10N 2240/401; F01M 9/04; F01M 11/0458; F01M 2011/047; C10M 169/04; C10M 101/04; C10M 175/00; C10M 2203/1006; C10M 2203/024; C10M 2007/404; C10M 2007/2805; C10M 2007/282; C10M 2007/283; C10M 2007/2835; C10M 2007/4045; C10M 2005/0285; C10M 2005/16; C10M 2240/04; C10M 2240/104; C10M 2240/401
See application file for complete search history.

(56) References Cited

U.S. PATENT DOCUMENTS

| | | | | |
|---|---|---|---|---|
| 2003/0069146 | A1* | 4/2003 | Garmier | C10M 169/04 508/491 |
| 2003/0176301 | A1* | 9/2003 | Barnes | C10M 111/04 508/458 |
| 2004/0241309 | A1* | 12/2004 | Garmier | A23D 9/00 426/601 |
| 2006/0035794 | A1 | 2/2006 | Graiver et al. | |
| 2010/0105583 | A1* | 4/2010 | Garmier | C10M 169/04 508/155 |
| 2010/0120639 | A1 | 5/2010 | Thoen et al. | |
| 2011/0010791 | A1 | 1/2011 | Bilyeu et al. | |
| 2011/0191916 | A1* | 8/2011 | Erickson | A01H 5/10 800/300 |
| 2011/0293785 | A1 | 12/2011 | Franklin et al. | |

OTHER PUBLICATIONS

Schmidt, Monica A. et al., Biotechnological Enhancement of Soybean Oil for Lubricant Applications, XP055403719, Dec. 22, 2005, pp. 389-397.

* cited by examiner

| | Palmitic | Stearic | Oleic | Linoleic | Linolenic |
|---|---|---|---|---|---|
| Commodity | 11 | 4 | 22 | 55 | 8 |
| VISTIVE GOLD | 3 | 3 | 70 - 75 | 15 | <3 |

UTILIZATION OF TRANSGENIC HIGH OLEIC SOYBEAN OIL IN INDUSTRIAL APPLICATIONS

CROSS REFERENCE TO RELATED APPLICATION

This application is a US National patent application which claims priority to PCT Application No. PCT/US2015/028980 filed May 4, 2015 which claims the benefit of priority to U.S. Provisional Application No. 61/989,259, filed on May 6, 2014.

FIELD OF THE INVENTION

The present invention is directed to high oleic acid oil compositions derived from transgenic soybeans and their use as enhanced cold pour agents, lubricants, and penetrants for internal combustion engines or other mechanical apparatus.

BACKGROUND

The present invention provides a process whereby a transgenic plant oil with a unique fatty acid composition, "transgenic high oleic soybean oil" or "HOSO" is used alone or as a component of industrial oils to enhance the cold pour characteristics and other performance aspects of such oils including their lubricity and biodegradability.

As is known, engine oils are used for lubrication of various metal components of internal combustion engines. The main function of these oils is to reduce wear on moving parts; it also acts to clean the engine, improve engine seals, and cool the engine by carrying heat away from moving parts. The coating of metal engine or components thereof with oil also keeps them from being exposed to oxygen, inhibiting oxidation at elevated operating temperatures acting to prevent or eliminate rust and/or corrosion. Many engine oils also have detergents and/or dispersants as components to help keep the engine clean and minimize oil retention, some of which can aid with one or more of these issues but none of which remove the problem entirely.

Typically, engine oils and lubricants have been derived from petroleum-based chemical compounds. More specifically, mineral oils, produced from petroleum, have been the primary source of engine lubricants and become the base oil for these application. Chemically, these petroleum oils are structurally composed of naphthenic, parafinic or aromatic structures. To enhance performance in one or more characteristics this base hydrocarbon stock has compounds added to it, these compounds are identified as additives. To distinguish among the characteristics, napthenic structures generally have low viscosity, good pour points and poor oxidative stability. Paraffinic structures also have common characteristics: they have higher viscosity, high pour points and good oxidative stability. Meanwhile, aromatic structures generally have very high viscosity, variable pour points and poor oxidative stability.

The bulk of a typical engine oil composition consists of hydrocarbons with between 18 and 34 carbon atoms per molecule. As mentioned above, their function is to maintain a lubricant film between moving parts. The viscosity of a liquid can be thought of as its "thickness" or a measure of its resistance to flow in these situations. To be useful in the engine oil context, the viscosity must be high enough to maintain a lubricating film at operating temperatures, but low enough that the oil can flow around the engine parts under all conditions. Often this balance is difficult to maintain. The viscosity index is a measure of how much the oil's viscosity changes as temperature changes, or its resistance to thinning relative to temperature. The higher the viscosity index of a fluid, the less it changes its composition with temperature changes. Typically lubricants contain 90% base oil (most often petroleum fractions, called mineral oils) and less than 10% additives. Additives deliver reduced friction and wear, increased viscosity, improved viscosity index, resistance to corrosion and oxidation, aging or contamination, etc. As an example, various polymeric substances are added to the base oil to improve viscosity and act as a dispersant. Micronized polytetraflouroethylene (PTFE) is added to provide lubricity and reduce engine wear. Various amines, metal phenates and zinc salts can be added as antioxidants.

Lubricants are added to gasoline in typical 2-cycle oils where a fuel source and lubrication are needed. Sulfur impurities in such fuels also provide some lubrication properties, which have to be taken in account when switching to a low-sulfur diesel; biodiesel is a popular diesel fuel additive providing additional lubricity. In 1999, an estimated 37,300,000 tons of lubricants were consumed worldwide. Automotive applications dominate this use, but other industrial, marine, rail and metal working applications are also big consumers of lubricants.

Engine oil must be able to flow adequately at the lowest temperature it is expected to experience in normal operations in order to minimize metal-to-metal contact between moving parts upon starting up the engine and/or during operation. The lowest temperature for which this pour point property is defined is the "cold pour" point and represents the lowest temperature that the fluid in question can provide the needed lubricant film to protect the identified engine, by extension; this is also the lowest temperature at which the engine can be safely operated.

It is known in the petroleum industry to source non-petroleum based oil components to assist with engine oil efficiency and viscosity issues. However, most engine oils today remain petroleum based blends composed of hydrocarbons, polyalphaolefins ("PAO"), and polyinternal olefins ("PIO") with a relatively narrow temperature range for optimal operation. The use of lubricants and additives in engine oils for the purpose of reducing friction, corrosion and wear is well known. However, petroleum based products have significant issues that include their lack of biodegradability, high price and price variability, sourcing difficulties, sustainability and toxicity. In addition, engine oil formulas developed for a specific situation may not provide a great range of temperatures for optimal engine protection.

Given the significant limitations identified herein, lubricant manufacturers have tried for many years to use soybean oil and other vegetable oils as a base stock to meet growing demand for a more biodegradable, non-toxic, less costly and renewable product which would also have the benefit of reducing dependence on international and often distant sources of petroleum. However, until the current invention commodity vegetable oils' fatal flaws of poor oxidative stability and poor cold flow temperature properties severely limited its usefulness in the lubricant market. Likewise, the use of commodity soybean oils in grease formulations is unpredictable with extremes of heat or cold. Such soybean oil based greases can partially freeze prematurely at cold temperatures or prematurely partially melt at high temperatures.

Thus the availability of a plant-sourced renewable oil with superior cold pour characteristics and enhanced thin film strength would be a step change in engine treatment and/or maintenance. The applications for the current invention in engine maintenance, lubrication, grease formulations and engine cleaning are significant. The transgenic soybean oil of the invention, with its distinct composition, is renewable sustainable, low cost and non-toxic. It is composed of a polar vegetable oil that is attracted to metals and through this attraction offers superior film strength, a high viscosity index and is resistant to both high temperatures and pressures.

Similarly, rail curve lubrication using wayside gauge face lubrication systems is widely used by the railway industry. While the goal is to provide cost-effective solutions to reduce rail/wheel wear, energy consumption, costs and noise success in research efforts on cost-effective friction management solutions have been limited. Currently, while there are no specific performance measures available for heavy haul rail curve lubrication, the performance of in-rail lubrication seems to be poor in most cases. A substance that could improve the effective performance of rail curve grease would enhance rail curve functionality would enhance railway reliability, safety and reduce transport costs.

SUMMARY OF THE INVENTION

The present disclosure includes the incorporation of oil from transgenic plants genetically modified to contain significant quantities of oleic acid for use in industrial applications, particularly those relying on enhanced cold pour requirements and increased lubricity and stability for grease compositions. The invention first relates the use of a soybean oil comprising a linolenic acid content of less than about 6% of total seed fatty acids by weight and an oleic acid content of about 55% to about 80% of total seed fatty acids by weight. Such oil is provided by making one or more soybean plants that comprise a transgene that decreases the expression of an endogenous soybean FAD2-1 gene and at least one loss-of-function mutation in an endogenous soybean FAD3 gene.

The transgenic high oleic soybean oil (HOSO) of the current invention provides a solution to the problems listed above. The HOSO of the current invention has been demonstrated to act as an industrial fluid additive that has an extremely low pour point. When added to existing engine oils, hydraulic fluids, engine penetrants or other petroleum based fluids, it makes these fluids capable of enhanced cold weather operation with a significantly broader operating temperature range. The transgenic soybean oil of the current invention will lower the pour point of engine, hydraulic and gear oils while not appreciably changing the high temperature viscosity. By allowing the pour point to be lowered, hydraulic pumps are also saved from cold startup problems and possible burn outs. Moreover, engine and lubricant applications that the compositions of the invention are used in are capable of remaining available for use all year round, even in cold weather conditions thereby eliminating the need to seasonally change engine fluids or apparatus lubricants.

According to the current invention the HOSO would also provide a new and predictable performance level for soybean-based base oils and greases with enhanced performance at temperature extremes. In addition the current invention provides a bio-based grease that would not have the toxicity of conventional petroleum-based greases. Grease compositions made with the HOSO of the invention provide better performance at cold temperatures due its cold flow properties and oxidative stability both acting to improve grease functionality including rail curve grease functionality.

DETAILED DESCRIPTION

Figures 1, 2:
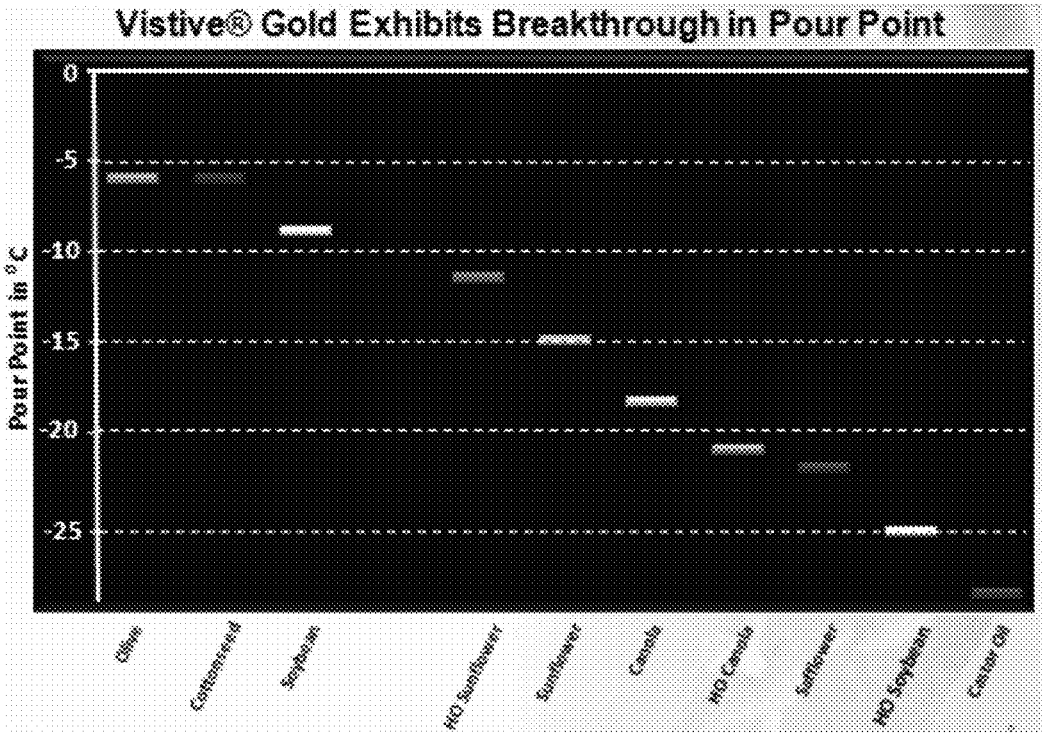
FIG. 1 is a table detailing the fatty acid profile of commodity soy versus the transgenic high oleic soybean oil of the invention (VISTIVE® GOLD).
FIG. 2 is a graph showing the pour point of various oils.
Figure 3:
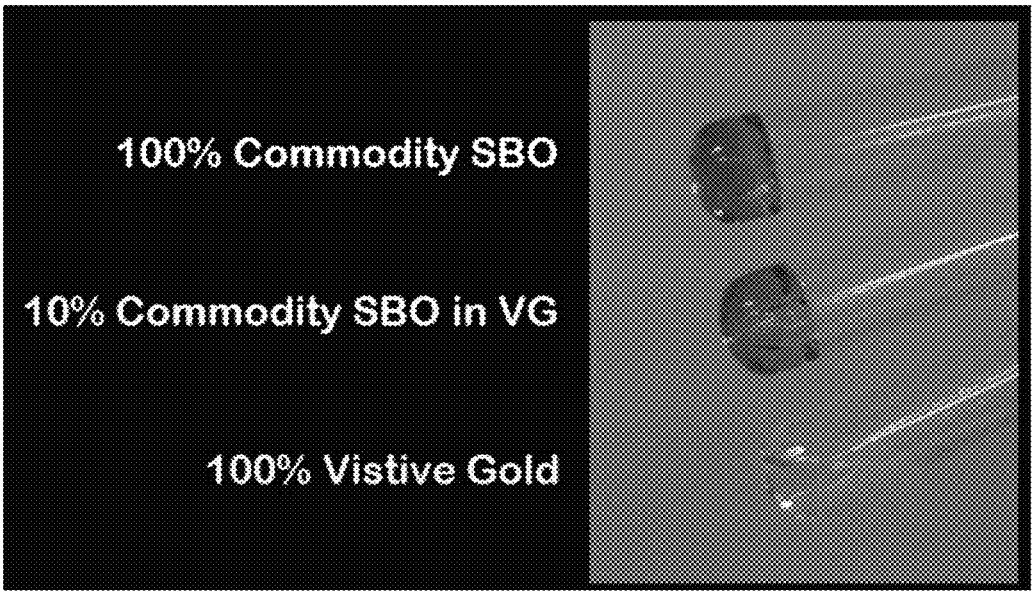
FIG. 3 shows examples of polymerization for commodity soybean oil, a blend of commodity soybean oil and VISTIVE® GOLD.
Figure 4:
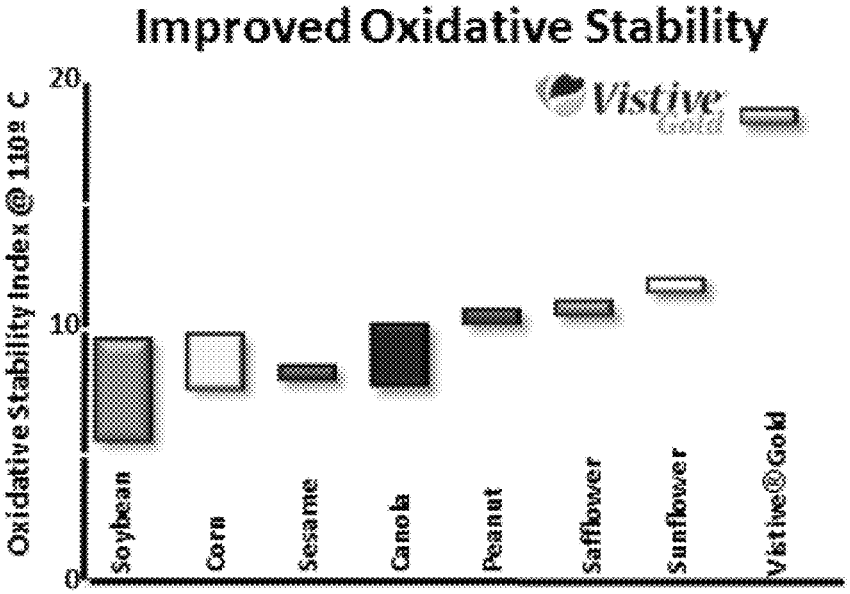
FIG. 4 is a graph of the oxidative stability index (OSI) for various oils.
Figure 5:
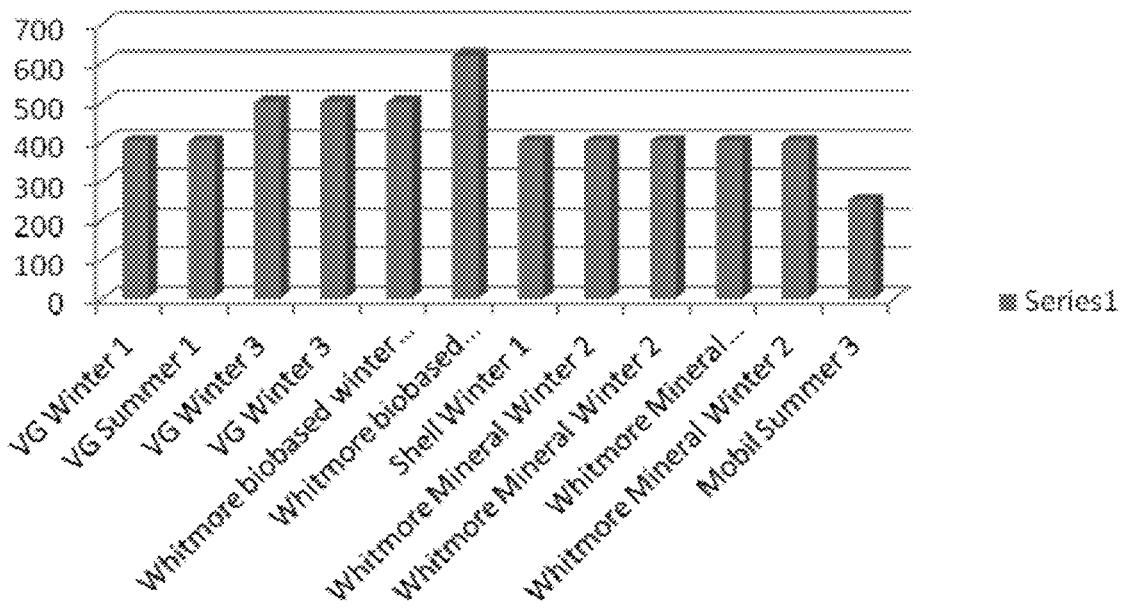
FIG. 5 is a graph of the rail curve data in the four ball extreme pressure test.

Plant oils are used in a variety of industrial applications, depending upon their individual compositions and availability. Soybean oil typically contains about 16-20% saturated fatty acids: 13-16% palmitate and 3-4% stearate. See generally, Gunstone et al., The LIPID HANDBOOK, Chapman & Hall, London (1994). The HOSO of the current invention has changed this oil profile, and its utility considerably.

According to previous inventions inhibition of the endogenous FAD2 gene through use of transgenes that inhibit the expression of FAD2 has been shown to confer a desirable mid-oleic acid (18:1) phenotype (i.e. soybean seed comprising about 50% and 75% oleic acid by weight) providing the HOSO of the invention. Transgenes and transgenic plants that provide for inhibition of the endogenous FAD2 gene expression and a mid-oleic phenotype are disclosed in U.S. Pat. Nos. 7,067,722 and 7,943,818, herein incorporated by reference.

Chemically, oleic acid has one double bond, but remains stable at high temperatures, and the soybean oil of the invention are suitable for processes where heating is required. It is also preferable to use oils, like that of the current invention, with oleic acid levels greater than 55% by weight in order to improve oxidative stability for industrial uses.

According to the current invention, HOSO oils have various unique characteristics that make them ideally suited to use as additives in various industrial compositions. According to the current invention they have surprising characteristics when used as cold pour agents or components, particularly coatings for high performance engines that will run at higher temperatures for a longer period. The results of the present invention demonstrates the unique properties of HOSO oils in applications where a formation of a lubricant coating between moving parts would be beneficial. This is particularly true for low temperature uses of machinery.

The results of the present invention confirm the unique properties of HOSO Soybean Oil in applications where a formation of a coating would be beneficial and when enhanced cold pour characteristics of the oil will be desirable.

In some of the various embodiments, the oil composition comprises at least about 45 wt. % or more of oleic acid, based on the total weight of fatty acids or derivatives thereof in the composition. In this embodiment, the oil composition is derived from genetically-modified soybean seeds. In total loss applications, such as rail oils and chain oils, it provides superior lubricity, heat transfer and rapid degradation after disposal desired by users. Preferably the HOSO base oil composition is at least 65% oleic acid.

This invention improves the cold temperature performance of soybean oil based lubricants and greases and matches or exceed those of lubricants and greases made from high oleic canola, rapeseed, or sunflower oils. Current vegetable oil based greases are made by reacting the base vegetable oil with various thickening agents like lithium hydroxide. The soap made through this process is mixed with oil to form grease. Since vegetable oils are made of a number of fatty acids with different melting points, when reacted with lithium hydroxide, they results in a mixture of different soaps and form grease containing soaps with different melting points. In extreme temperature applications these greases behave unpredictably because various soap portions of the grease would freeze at different temperatures resulting in performance failures especially when the grease is applied through small nozzles or pumped through long lines. As an example when grease is applied through centralized greasing systems for semi-trucks, the grease is pumped through steel tubing from the reservoirs to all grease zerks at various bearings or joints.

Also, according to the current invention, solvent extracted oils are also acceptable although some of the natural antioxidants are destroyed in processing and must be replaced for the HOSO oil. Synthetic antioxidants include alkylated phenols, polyethers, substituted triazoles and diphenolamines and may be used to replace or enhance natural antioxidants. Synthetic antioxidants may vary from 0.1% to 5% of the blended oil composition. The high oleic base oils are typically used in their unrefined state. Unrefined means that no degumming, bleaching or deodorizing of the oil is used. The use of commercially prepared variant oils (denuded of gums, waxes, alcohols and antioxidants) would then require the use of commercial lectins, waxes and antioxidants prior to use.

Also, in other embodiments, oil compositions of the invention comprise at least 40, 41, 42, 43, 44 or 45 wt. % or more oleic acid or a derivative thereof based upon the total weight of fatty acids or derivatives thereof in the composition.

In a preferred oil preparation, the oil preparation is a high oil preparation with an oil content derived from a plant or part thereof of the present invention of greater than 5% w/v, more preferably 10% w/v, and even more preferably 15% w/v. In a preferred embodiment the oil preparation is a liquid and of a volume greater than 1, 5, 10 or 50 liters. The present invention provides for oil produced from plants of the present invention or generated by a method of the present invention. Such oil may exhibit enhanced oxidative stability. Also, such oil may be a minor or major component of any resultant product.

Moreover, such oil may be blended with other oils. In a preferred embodiment, the oil produced from plants of the present invention or generated by a method of the present invention constitutes greater than 0.5%, 1%, 5%, 10%, 25%, 50%, 75% or 90% by volume or weight of the oil component of any product. In another embodiment, the oil preparation may be blended and can constitute greater than 10%, 25%, 35%, 50% or 75% of the blend by volume. Oil produced from a plant of the present invention can be admixed with one or more organic solvents or petroleum distillates.

Definitions

As used herein a "plant cell" means a plant cell that is transformed with stably-integrated, non-natural, recombinant DNA, e.g. by *Agrobacterium*-mediated transformation or by bombardment using microparticles coated with recombinant DNA or other means. A plant cell of this invention can be an originally-transformed plant cell that exists as a microorganism or as a progeny plant cell that is regenerated into differentiated tissue, e.g. into a transgenic plant with stably-integrated, non-natural recombinant DNA, or seed or pollen derived from a progeny transgenic plant.

As used herein a "transgenic plant" includes a plant, plant part, plant cells or seed whose genome has been altered by the stable integration of recombinant DNA. A transgenic plant includes a plant regenerated from an originally-transformed plant cell and progeny transgenic plants from later generations or crosses of a transformed plant.

As used herein "recombinant DNA" means DNA which has been a genetically engineered and constructed outside of a cell.

Lubricant: As used herein this is a substance, as oil or grease, for lessening friction, especially in the working parts of an engine or mechanism with moving parts.

Engine Penetrant: As used herein this is a substance that lowers the surface tension of a liquid and thus causes it to penetrate or be absorbed more easily on or around a mechanical component.

2-cycle engine oil: As used herein this is an engine oil composition intended for use in crankcase compression two-stroke engines. The oil-base stock is mixed with gasoline at a fuel-to-oil ratio ranging from 16:1 to as low as 100:1. The two-stroke oil is ultimately burned along with the fuel as a total-loss oiling/lubrication system. This results in increased exhaust emissions, sometimes with blue smoke and/or a distinctive odor.

Rail Curve Grease: As used herein this is a grease used on rails to reduce friction and thereby reduce energy use, noise and wear on railway components.

Hydraulic Oil: As used herein hydraulic oils, also called hydraulic liquids, are the medium by which power is transferred in hydraulic machinery. Common hydraulic fluids are based on mineral oil or water. Examples of equipment that might use hydraulic fluids include excavators and backhoes, hydraulic brakes, power steering systems, elevators, transmissions, garbage trucks, aircraft flight control systems, lifts, and industrial machinery.

Additionally, the oil compositions described herein can be used to enhance a variety of industrial compounds including, without limitation, the following industrially important compounds: Anti-Seize Compounds, Biodegradable Lubricants, Chain Lubricants, Cleaners & Degreasers, Compressor Lubricants, Gear Oils, Greases, Hydraulic Oils, Mining Lubricants, Open Gear Lubricants, Penetrating Oil, Rail Lubricants and Synthetic Lubricants.

Transgenic Soybeans, and Methods for Producing Same

Any of the nucleic acid molecules and constructs of the invention may be introduced into a soybean plant or plant cell in a permanent or transient manner. Methods and technology for introduction of DNA into soybean plant cells are well known to those of skill in the art, and virtually any method by which nucleic acid molecules may be introduced into a cell is suitable for use in the present invention. Non-limiting examples of suitable methods include: chemical methods; physical methods such as microinjection, electroporation, the gene gun, micro projectile bombardment, and vacuum infiltration; viral vectors; and receptor-mediated mechanisms. Other methods of cell transformation can also be used and include but are not limited to introduction of DNA into plants by direct DNA transfer into pollen, by direct injection of DNA into reproductive organs of a plant, or by direct injection of DNA into the cells of immature embryos followed by the rehydration of desiccated embryos.

*Agrobacterium*-mediated transfer is a widely applicable system for introducing genes into plant cells. See, e.g., Fraley et al., Bio/Technology 3:629-635 (1985); Rogers et al., Methods Enzymol. 153:253-277 (1987). The region of DNA to be transferred is defined by the border sequences and intervening DNA is usually inserted into the plant genome. Spielmann et al., Mol. Gen. Genet. 205:34 (1986). Modern *Agrobacterium* transformation vectors are capable of replication in *E. coli* as well as *Agrobacterium*, allowing for convenient manipulations. Klee et al., In: Plant DNA Infectious Agents, Hohn and Schell (eds.), Springer-Verlag, New York, pp. 179-203 (1985). *Agrobacterium*-mediated transformation of soybean is specifically described in U.S. Pat. No. 7,002,058.

Transgenic plants are typically obtained by linking the gene of interest (i.e., in this case a transgene that decreases expression of an endogenous soybean FAD2-1 gene or that decreases expression of both an FAD2-1 gene or FATB gene) to a selectable marker gene, introducing the linked transgenes into a plant cell, a plant tissue or a plant by any one of the methods described above, and regenerating or otherwise recovering the transgenic plant under conditions requiring expression of said selectable marker gene for plant growth. Exemplary selectable marker genes and the corresponding selective agents have been described in preceding sections of this description of the invention.

Transgenic plants can also be obtained by linking a gene of interest (i.e. in this case a transgene that decreases expression of an endogenous soybean FAD2-1 gene or that decreases expression of both an FAD2-1 gene or FATB gene) to a scoreable marker gene, introducing the linked transgenes into a plant cell by any one of the methods described above, and regenerating the transgenic plants from transformed plant cells that test positive for expression of the scoreable marker gene. Exemplary scoreable marker genes have been described in preceding sections of this description of the invention.

The regeneration, development and cultivation of plants from single plant protoplast transformants or from various transformed explants is well known in the art. See generally, Maliga et al., Methods in Plant Molecular Biology, Cold Spring Harbor Press (1995); Weissbach and Weissbach, In: Methods for Plant Molecular Biology, Academic Press, San Diego, Calif. (1988). Plants of the present invention can be part of or generated from a breeding program, and may also be reproduced using apomixis. Methods for the production of apomictic plants are known in the art. See, e.g., U.S. Pat. No. 5,811,636.

In order to prepare the oil compositions described above from a transgenic plant, specifically soybeans, the following steps are generally used to process seed oils: preparation, cracking and dehulling, conditioning, milling, flaking or pressing, extracting, degumming, refining, bleaching and deodorizing. Each of these steps will be discussed are relatively well known in the art. This discussion details the current commercial process for each of the steps from soybean. A person of ordinary skill would know that the steps could be combined, used in a different order or otherwise modified depending upon the crop from which the oil is extracted and the use for which it is destined.

Generally, the preparation step includes the initial seed cleaning process, which removes stones, dirt, sticks, worms, insects, metal fragments, and other debris collected during the harvest and storage of the seeds. Extraneous matter as described above can affect the quality of the final seed oil by containing compounds that negatively impact its chemical stability. Preferably, ripe, unbroken seeds having reduced levels of chlorophyll, are properly dried and with reduced levels of free fatty acids are used.

Once the seeds are cracked and dehulled, they are conditioned to make the seed meats pliable prior to further processing. Furthermore, the conditioning promotes rupturing of oil bodies. Further processing, in terms of flaking, grinding or other milling technology is made easier by having pliable seed meats at this stage. Generally, the seed meats have moisture removed or added in order to reach a 6-14 wt. % moisture level. If moisture is removed, this process is called toasting or cold pour and if moisture is added, this process is called cooking or tempering. Typically, the seed meats are heated to 40-90° C. with steam which is dry or wet depending on the direction of adjustment of the moisture content of the seed meats. In some instances, the conditioning step occurs under conditions minimizing oxygen exposure or at lower temperatures for seeds having high oleic acid levels.

Once the seed meats are conditioned, they can be milled to a desired particle size or flaked to a desired surface area. In certain cases, the flaking or milling occurs under conditions minimizing oxygen exposure. Flaking or milling is done to increase the surface area of the seed meats and also rupture the oil bodies thereby facilitating a more efficient extraction. Many milling technologies are appropriate and are well known in the art. The considerations when choosing a method of milling and a particle size for the ground seed are contingent upon, but not limited to the oil content in the seed and the desired efficiency of the extraction of the seed meats or the seed. When flaking the seed meats, the flakes are typically from about 0.1 to about 0.5 mm thick; from about 0.1 to about 0.35 mm thick; from about 0.3 to about 0.5 mm thick; or from about 0.2 to about 0.4 mm thick.

Optionally, after the seed meats are milled, they can be pressed. Typically, the seed meats are pressed when the oil content of the seed meats is greater than about 30 wt. % of the seeds. However, seeds with higher or lower oil contents can be pressed. The seed meats can be pressed, for example, in a hydraulic press or mechanical screw. Typically, the seed meats are heated to less than about 55° C. upon the input of work. When pressed, the oil in the seed meats is pressed through a screen, collected and filtered. The oil collected is the first press oil. The seed meats from after pressing are called seed cake; the seed cake contains oil and can be subjected to solvent extraction.

After milling, flaking or optional pressing, the oil can be extracted from the seed meats or seed cake by contacting them with a solvent. Preferably, n-hexane or iso-hexane is used as the solvent in the extraction process. Typically, the solvent is degassed prior to contact with the oil. This extraction can be carried out in a variety of ways, which are well known in the art. For example, the extraction can be a batch or continuous process and desirably is a continuous counter-current process. In a continuous counter-current process, the solvent contact with the seed meat leaches the oil into the solvent, providing increasingly more concentrated miscellas (i.e., solvent-oil), while the marc (i.e., solvent-solids) is contacted with miscellas of decreasing concentration. After extraction, the solvent is removed from the miscella in a manner well known in the art. For example, distillation, rotary evaporation or a rising film evaporator and steam stripper can be used for removing the solvent. After solvent removal, if the crude oil still contains residual solvent, it can be heated at about 95° C. under reduced pressure at about 60 mmHg.

According to the current invention, the above processed crude soybean oil contains hydratable and nonhydratable phosphatides. Accordingly, the crude oil is degummed to remove the hydratable phosphatides by adding water and heating to from about 40 to about 75° C. for approximately 5-60 minutes depending on the phosphatide concentration. Optionally, phosphoric acid and/or citric acid can be added to convert the nonhydratable phosphatides to hydratable phosphatides. Phosphoric acid and citric acid form metal complexes, which decreases the concentration of metal ions bound to phosphatides (metal complexed phosphatides are nonhydratable) and thus, converts nonhydratable phosphatides to hydratable phosphatides. Optionally, after heating with water, the crude oil and water mixture can be centrifuged to separate the oil and water, followed by removal of the water layer containing the hydratable phosphatides. Generally, if phosphoric acid and/or citric acid are added in the degumming step, about 1 wt. % to about 5 wt. %; preferably, about 1 wt. % to about 2 wt. %; more preferably, about 1.5 wt. % to about 2 wt. % are used. This process step is optionally carried out by degassing the water and phosphoric acid before contacting them with the oil to remove oxygen in order to minimize oxidation thus maximizing oil quality.

Furthermore, the crude oil contains free fatty acids (FFAs), which can be removed by a chemical (e.g., caustic) refining step. When FFAs react with basic substances (e.g., caustic) they form carboxylic acid salts or soaps that can be extracted into aqueous solution. Thus, the crude oil is heated to about 40 to about 75° C. and NaOH is added with stirring and allowed to react for approximately 10 to 45 minutes. This is followed by stopping the stirring while continuing heat, removing the aqueous layer, and treating the neutralized oil to remove soaps. The oil is treated by water washing the oil until the aqueous layer is of neutral pH, or by treating the neutralized oil with a silica or ion exchange material. The oil is dried at about 95° C. and about 10 mmHg. In some instances, the caustic solution is degassed before it contacts the oil.

Alternatively, rather than removing FFAs from the oil by chemical refining, the FFAs can be removed by physical refining. For example, the oil can be physically refined during deodorization. When physical refining is performed, the FFAs are removed from the oil by vacuum distillation performed at low pressure and relatively higher temperature. Generally, FFAs have lower molecular weights than triglycerides and thus, FFAs generally have lower boiling points and can be separated from triglycerides based on this boiling point difference and through aid of nitrogen or steam stripping used as an azeotrope or carrier gas to sweep volatiles from the deodorizers.

Typically, when physical refining rather than chemical refining is performed, oil processing conditions are modified to achieve similar final product specifications. For example, when an aqueous acidic solution is used in the degumming step, a higher concentration of acid (e.g., up to about 100% greater concentration, preferably about 50% to about 100% greater concentration) may be needed due to the greater concentration of non-hydratable phosphatides that could otherwise be removed in a chemical refining step. In addition, a greater amount of bleaching material (e.g., up to about 100% greater amount, preferably about 50 to about 100% greater amount) is used.

Before bleaching citric acid (50 wt. % solution) can be added at a concentration of about 0.01 wt. % to about 5 wt. % to the degummed oil and/or chemically refined oil. This mixture can then be heated at a temperature of about 35° C. to about 65° C. and a pressure of about 1 mmHg to about 760 mmHg for about 5 to about 60 minutes.

The degummed oil and/or chemically refined oil is subjected to an absorption process (e.g., bleached) to remove peroxides, oxidation products, phosphatides, keratinoids, chlorphyloids, color bodies, metals and remaining soaps formed in the caustic refining step or other processing steps. The bleaching process comprises heating the degummed oil or chemically refined oil under vacuum of about 0.1 mmHg to about 200 mmHg and adding a bleaching material appropriate to remove the above referenced species (e.g., neutral earth (commonly termed natural clay or fuller's earth), acid-activated earth, activated clays and silicates) and a filter aid, whereupon the mixture is heated to about 75-125° C. and the bleaching material is contacted with the degummed oil and/or chemically refined oil for about 5-50 minutes. It can be advantageous to degas the bleaching material before it contacts the refined oil. The amount of bleaching material used is from about 0.25 wt. % to about 3 wt. %, preferably about 0.25 wt. % to about 1.5 wt. %, and more preferably about 0.5 wt. % to about 1 wt. %. After heating, the bleached oil or refined, bleached oil is filtered and deodorized.

The bleached oil or refined, bleached oil is deodorized to remove compounds with strong odors and flavors as well as remaining free fatty acids. The color of the oil can be further reduced by heat bleaching at elevated temperatures. Deodorization can be performed by a variety of techniques including batch and continuous deodorization units such as batch stirred tank reactors, falling film evaporators, wiped film evaporators, packed column deodorizers, tray type deodorizers, and loop reactors. Typically, a continuous deodorization process is preferred. Generally, deodorization conditions are performed at about 160 to about 270° C. and about 0.002 to about 1.4 kPa. For a continuous process, particularly in a continuous deodorizer having successive trays for the oil to traverse, a residence time of up to 2 hours at a temperature from about 170° C. to about 265° C.; a residence time of up to about 30 minutes at a temperature from about 240° C. to about 250° C. is preferred. Deodorization conditions can use carrier gases for the removal of volatile compounds (e.g., steam, nitrogen, argon, or any other gas that does not decrease the stability or quality of the oil).

Furthermore, when physical rather than chemical refining is used, a greater amount of FFAs are removed during the deodorization step, and the deodorizer conditions are modified to facilitate the removal of free fatty acids. For example, the temperature is increased by about 25° C.; oils can be deodorized at temperatures ranging from about 165° C. to about 300° C. In particular, oils can be deodorized at temperatures ranging from about 250° C. to about 280° C. or about 175° C. to about 205° C. In addition, the retention time of the oil in the deodorizer is increased by up to about 100%. For example, the retention time can range from less than about 1, 5, 10, 30, 60, 90, 100, 110, 120, 130, 150, 180, 210 or 240 minutes. Additionally, the deodorizer pressure can be reduced to less than about $3\times10^{-4}$, $1\times10^{-3}$, $5\times10^{-3}$, 0.01, 0.02, 0.03, 0.04, 0.05, 0.06, 0.07, 0.08, 0.09, or 0.1 kPa. The deodorization step results in refined, bleached and deodorized (RBD) oil.

Optionally, RBD oils can be stabilized by partial hydrogenation and/or by the addition of stabilizers or by minimizing the removal or degradation of microcomponents that aid in maintaining oil stability and quality. Partial hydrogenation stabilizes an oil by reducing the number of double bonds in the fatty acids contained in the oil and thus, reducing the chemical reactivity of the oil. However, partial hydrogenation can increase the concentration of undesirable trans-fatty acids.

Stabilizers generally act to intercept free radicals formed during oxidation. Interception of the free radicals by stabilizers, which become either more stable free radicals or rearrange to become stable molecules, slows the oxidation of the oil due to the decreased concentration of highly reactive free radicals that can oxidize more fatty acid units.

For each of the above steps, at each step the exposure to oxygen was optionally minimized, the exposure to heat was optionally minimized, the exposure to UV light was optionally minimized and optionally, stabilizers were added to the seed meats or seed oil before, during, or after processing. These and other process improvements for preparing oils of the present invention are described and exemplified in U.S. patent application Ser. No. 11/267,810 entitled "Processes for Preparation of Oil Compositions" filed Nov. 4, 2005, which is incorporated by reference herein in its entirety.

Vegetable oils consist of glycerol esters of fatty acids, which are long hydrocarbon chains with a terminal carboxyl group. In oil autoxidation, oxygen attacks a hydrocarbon chain, often at the site of allylic hydrogen (a hydrogen on a carbon atom adjacent to a double bond). This produces a free radical, a substance with an unpaired electron which makes it highly reactive. A series of addition reactions ensue. Each step produces additional free radicals, which then engage in further polymerization. The process finally terminates when free radicals collide, combining their unpaired electrons to form a new bond. The polymerization stage occurs over a period of days to weeks, and renders the film dry to the touch.

Because the oil compositions of the invention are highly unsaturated, they can be used as cold pour oils. Typically, these oils are used in coating compositions (e.g., paint, varnish, etc.) at concentrations of up to 100 wt. %. In various formulations, the coating composition can include pigments and other additives at low concentrations. In those formulations, the concentration of the cold pour oil would be decreased accordingly.

In various embodiments, the cold pour oil is boiled, which is heating the oil with bubbling of oxygen to speed the cold pour process by pre-oxidizing the oil. Oxidation catalysts, typically metal naphthenates, can also be added in order to accelerate cure.

TABLE 1

| Oil | Pour Point (° C.) |
|---|---|
| HOSO | −25 |
| Apricot Kernel | −16 |
| Avocado | −3 |
| Castor | −28 |
| Corn | −15 |
| Cottonseed | −6 |
| Flaxseed | −12 |
| Grapeseed | −12 |
| Hempseed | −15.8 |
| Jojoba - refined | 9 |
| Jojoba - golden | 10.7 |
| Macadamia | −5 |
| Oleic acid | 3 |
| Olive | −6 |
| Poppyseed | −18 |
| Ricebran | −9 |
| Ricinoleic acid | −19 |
| Safflower | −22 |
| Sesame | −9 |
| Soy | −9 |
| Soy HOBO (08-204) | −12 |
| Sunflower | −15 |
| Walnut | −19 |

In reference to Table 1, the high oleic acid transgenic soybean oil of the invention would be further improved with the addition of pour point depressants and then provided as a biodegradable, non-toxic and low temperature oil for the lubricant industry. Oleic acid has one double bond, but is still relatively stable at high temperatures, and oils with high levels of oleic acid are suitable for processes where heating is required. The present invention utilizes a transgenic soybean seed exhibiting an oil composition comprising 55 to 80% by weight oleic acid, 10 to 40% by weight linoleic acid, 6% or less by weight linolenic acid, and 2 to 8% by weight saturated fatty acids, and also provides a soybean seed exhibiting an oil composition comprising 65 to 80% by weight oleic acid, 10 to 30% by weight linoleic acid, 6% or less by weight linolenic acid, and 2 to 8% by weight of saturated fatty acids. In another embodiment, the present invention utilizes a soybean seed exhibiting an oil composition comprising about 65-80% oleic acid, about 3-8% saturates, and about 12-32% polyunsaturates. In another embodiment, the present invention provides a soybean seed exhibiting an oil composition which comprises about 65-80% oleic acid, about 2-3.5% saturates, and about 16.5-33% polyunsaturates.

Metallic Compositions

One aspect of the present invention is directed to coating compositions containing oil compositions described herein. Such preservative compositions are useful in various applications provided herein.

The compositions of the invention can also contain rheological modifiers such as gelling agents to help lower the misting properties of a spray application and contribute to a faster cold pour and better polymerization activities as well as controlling the flow properties of the compound. Such gelling agents are typically organometallic compounds of aluminum or polyamide resins. Preferred gelling agents for the ink compositions are the organometallic compounds of aluminum, in particular, aluminum soaps, aluminum alkoxides or oxyaluminum acylates, most preferably, oxyaluminum acylates such as oxyaluminum octoate. When utilizing a gelling agent in the for the compositions of the current invention, the composition is desirably manufactured under an inert atmosphere, the gelling agent is pre-diluted with the solvent and the pre-diluted gelling agent is slowly added to the other components of the composition.

TABLE 2

| Product Attributes | Commodity Soybean | High Oleic Soybean | HOSO |
|---|---|---|---|
| Saturated Fat Reduction in Oil | 15% poor | 12% fair | 6% good |
| Saturated Fat Reduction in Food | poor | fair | good |
| Trans Fat Reduction in Food | poor | good | good |
| Flavor in Food | good | Very low 18:2 fair | good |
| Oxidative Stability | poor | good | good |
| Industrial Utility - Enhanced Pour Point | poor | fair | Low Saturates good |

Exemplary stabilizers can include 2,4,5-trihydroxybutyrophenone, 2,6-di-t-butylphenol, 3,4-dihydroxybenzoic acid, 3-t-butyl-4-hydroxyanisole, 4-hydroxymethyl-2,6-di-t-butylphenol, 6-ethoxy-1,2-dihydro-2,2,4-trimethylquinoline, anoxomer, ascorbic acid, ascorbyl palmitate, ascorbyl stearate, beta-apo-8'-carotenoic acid, beta-carotene, butylated hydroxyanisole (BHA), butylated hydroxytoluene (BHT), caffeic acid, calcium ascorbate, calcium disodium EDTA, canthaxanthin, carnosol, carvacrol, catalase, cetyl gallate, chlorogenic acid, citric acid, clove extract, coffee bean extract, D-α-tocopheryl acetate, dilauryl thiodipropionate, disodium citrate, disodium EDTA, DL-α-tocopherol, DL-α-tocopheryl acetate, dodecyl gallate, dodecyl gallate, D-α-tocopherol, edetic acid, erythorbic acid, esculetin, esculin, ethoxyquin, ethyl gallate, ethyl maltol, eucalyptus extract, ferulic acid, flavonoids (characterized by a carbon skeleton like $C_6$—$C_3$—$C_6$, typically two aromatic rings linked by a three carbon aliphatic chain which is normally condensed to form a pyran or less commonly a furan ring), flavones (such as apigenin, chrysin, luteolin), flavonols (such as datiscetin, nyricetin, daemfero), flavanones, chalcones, fraxetin, fumaric acid, gentian extract, gluconic acid, glucose oxidase, heptyl paraben, hesperetin, hydroquinone, hydroxycinammic acid, hydroxyglutaric acid, hydroxytyrosol, isopropyl citrate, lecithin, lemon juice solids, lemon juice, L-tartaric acid, lutein, lycopene, malic acid, maltol, methyl gallate, methylparaben, morin, N-hydroxysuccinic acid, nordihydroguaiaretic acid, octyl gallate, p-coumaric acid, phosphatidylcholine, phosphoric acid, p-hydroxybenzoic acid, phytic acid (inositol hexaphosphate), pimento extract, potassium bisulfite, potassium lactate, potassium metabisulfite, potassium sodium tartrate anhydrous, propyl gallate, pyrophospate, quercetin, ice bran extract, rosemary extract (RE), rosmarinic acid, sage extract, sesamol, sinapic acid, sodium ascorbate, sodium ascorbate, sodium erythorbate, sodium erythorbate, sodium hypophosphate, sodium hypophosphate, sodium metabisulfite, sodium sulfite, sodium thisulfate pentahydrate, sodium tryphosphate, soy flour, succinic acid, sucrose, syringic acid, tartaric acid, t-butyl hydroquinone (TBHQ), thymol, tocopherol, tocopheryl acetate, tocotrienols, trans-resveratrol, tyrosol, vanillic acid, wheat germ oil, zeaxanthin, α-terpineol, and combinations thereof.

One or more cold pour catalysts can be added to aid in the oxidation cold pour of the coating composition. Such cold pour catalysts are preferably metal salts of acylates or octoates, particularly cobalt and manganese metal salts.

The coating compositions described herein can be prepared in a conventional manner by mixing the components described herein to form a homogenous mixture. The properties of the coating compositions described herein can be tested by standard methods. Usually, the cold pour time, coating tack, rub resistance, misting, and water pickup of the compositions provide guidance in selected and improving the coating formulations.

Examples

The following non-limiting examples are provided to further illustrate the present invention. It should be noted that the following examples are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the concept, spirit and scope of the invention. More specifically, it will be apparent that certain agents which are both chemically and physiologically related may be substituted for the agents described herein while the same or similar results would be achieved. All such similar substitutes and modifications apparent to those skilled in the art are deemed to be within the spirit, scope and concept of the invention as defined by the appended claims.

Materials and Methods

Experiment #2

Hydraulic Fluids, Gear Lubricants, Multipurpose Engine Oils, Chain Oils

Winterization of HOSO

In order to improve the pour point of the HOSO an attempt was made to winterize the oil. The following process was developed:

TABLE 3

Basic Properties of the High Oleic Acid Transgenic Soybean Oil of the Current Invention

| | Vistive Gold Oil (12-026) | | Vistive Biodiesel (AN#####) | BIOD-1-2011 (12-027) | BIOD-237-11-718 (12-028) |
|---|---|---|---|---|---|
| Flash Point (COC) (° C.) | 330 | Flash Point (PM) (° C.) | | | 182 |
| Fire Point (COC) (° C.) | 350 | Copper Corrosion | | 1A | 1A |
| Flash Point (PM) (° C.) | 278 | Cloud Point (° C.) | | 7.1 | −5.4 |
| Viscosity (40° C.) (cSt) | 36.86 | OSI (hours) | | 6.52 | |
| Viscosity (100° C.) (cSt) | 8.239 | | | | |
| Viscosity Index | 194 | | | | |
| Foaming Characteristics (I) | | | | | |
| Foaming Characteristics (I, II, III) | | | | | |
| Dielectric Breakdown | 40.65 | | | | |
| OSI (hours) | 20.13 | | | | |
| Pour Point (° C.) | −25.00 | | | | |
| 4-ball EP (Kg) | 126 | | | | |
| 4-ball wear (cm) | 0.8255 | | | | |
| Pin & V | | | | | |
| Timken | | | | | |
| RPVOT (min) | 25 | | | | |
| Copper Corrosion | 1B | | | | |

Note1:
The oil of the invention was tested in the Pin & V test and the results showed 1640 lbs. This confirms that the oil of the invention has enhanced lubricity performance.

Procedure:

1. Fill three tin paint cans with 2500 mL of HOSO oil.
2. Prepare three 3000 mL glass beakers to use for filtering by covering them with cheesecloth.
3. Place all three metal cans in a Thermatron and set to 0° C.

4. After 24 hours, remove one of the paint cans and filter it into the beaker, removing the solidified oil.
5. Reset the Thermatron to −10° C.
6. After another 24 hours, remove a second paint can and filter it into a separate beaker.
7. Reset the Thermatron to −15° C.
8. After a final 24 hours, remove the last beaker of oil and filter into the last paint can.

Test Results/Observations

After the metal cans were in the thermatron at 0° C. for 24 hours, the oil had thickened and there was a thin, clear film on the top of the oil. There was no solidification of the oil observed. Once the oils were in the −10° C. temperature for 24 hours, most of the oil had already solidified. When we filtered it, there was only 330 grams of oil that had not solidified. We put the 330 grams of filtered oil back into the thermatron at −10° C. and it fully solidified after a few hours. Finally, once the last metal can was in the thermatron for 24 hours at −15° C., all of the oil had solidified.

Hydraulic Pump Test

The test protocol used to screen the stability of biobased hydraulic oils utilizes the ASTM D7043 "Standard Test Method for Indicating Wear Characteristics of Non-Petroleum and Petroleum Hydraulic Fluids in a Constant Volume Vane Pump". This test procedure was used because it correlates well with performance in the field. The ASTM D7043 test method supersedes two earlier ASTM tests because the pump test specimen known as the Vickers 104C vane pump was no longer available from the manufacturer. The new ASTM D7043 test method requires using a newer fixed displacement vane pump to pump a known quantity of the test oil at 79° C. and 6.95 MPa (1000 PSI) for a period of 1000 hours. As described by ASTM, the purpose of the test is to determine the amount of weight loss in certain components of the pump cartridge after the test. In the original intent of this test, a weigh loss of less than 50 mg indicates a pass for the test oil. Another version of this test would require using a higher pressure of 13.79 MPa (2000 PSI) but a lower temperature of 65° C. for a shorter period of 100 hours.

FIGS. 1 and 2 present the test stand arrangement as prepared according to the ASTM D4370 procedure and the pump cartridge currently being used in the revised ASTM test procedure.

When used for testing the anti-wear properties of hydraulic fluids, this test method requires that the weight measurements of the cam ring and the vanes taken before and after the test be compared. This pump has two sets of vanes called the inner vanes and the external vanes. A weight loss of less than 50 mg for the vanes and cam ring indicates a pass for the hydraulic fluid for this test. Biobased oils, typically, do well in passing this test due to their naturally higher lubricity. In the proposed protocol, however, it is proposed to use the changes in the viscosity of the oil as a measure of its oxidation stability. The weight measurements of the pump assemblies used in these tests were recorded.

According to the current invention three 1000-hour hydraulic oils tests on the HOSO oils were completed: NEAT, with Anti-Oxidant, and Formulated as Hydraulic oil as provided according to the invention. These tests were completed recently and the results indicate that further work will be needed to improve the oxidation stability of the HOSO if the oil is to be used for hydraulic oils.

TABLE 3

Changes in viscosity of HOSO oils in 1000 hydraulic pump test

| Sample | Viscosity (cSt) | Viscosity change from 0 to 1000 hours |
|---|---|---|
| HOSO Neat at 0 hr | 36.65 | |
| HOSO + Anti-Oxidant at 0 hr | 36.84 | |
| HOSO + ISO 46 Hyd. Additive Pack at 0 hr | 37.55 | |
| HOSO Neat at 1000 hr | 133.93 | 265% |
| HOSO + Anti-Oxidant at 1000 hr | 176.86 | 380% |
| HOSO + ISO 46 Hyd. Additive Pack at 1000 hr | 102.04 | 172% |

The results of these tests indicated that HOSO lacks proper oxidation stability for several industrial hydraulic oil applications. The HOSO oils with and without additives showed large increases in viscosities indicating poor oxidation stability in hydraulic applications.

TABLE 4

Changes in viscosity of three biobased hydraulic oils and three vegetable oils in 1000 hydraulic pump test

| Oil Sample | Viscosity @ 0 hrs in cSt. | Viscosity @ 1000 hrs in cSt. | Viscosity Difference in cSt. | % of Viscosity change from 0 to 1000 hours | Notes |
|---|---|---|---|---|---|
| Oil 1: Biobased UTTHF | 44.24 | 41.92 | −2.32 | −5% | Sheared first then began to increase |
| Oil 2: Biobased Hydraulic Oil 2 | 43.18 | 43.11 | −0.07 | 0% | Sheared first then leveled |
| Oil 3: Biobased Hydraulic Oil 3 | 45.36 | 54.79 | 9.43 | 20% | |
| Oil 4: Neat High Oleic Canola Oil | 37.51 | 115.6 | 78.09 | 208% | |
| Oil 5: Neat High Oleic Sunflower Oil | 39.34 | 113.3 | 73.96 | 188% | |
| Oil 6: High Oleic Sunflower Oil + AO | 39.19 | 105.7 | 66.51 | 170% | |

As indicated in Table 4, the bio-based oils 1, 2, and 3 are fully formulated hydraulic oils currently commercially available and only Oil 3 showed 20% change in viscosity which was considered unacceptable based on this test. The biobased UTTHF (Universal Tractor Transmission Hydraulic Fluid) showed a reduction in viscosity due to shearing of its additive package and biobased hydraulic oil #2 had no change in viscosity in this test. The HOSO+ISO 46 Hyd. Additive Pack (prepared by as a fully formulated hydraulic oil) had a 172% increase in its viscosity which would be failure of this test. Table 4 also shows the performance of high oleic canola oil and high oleic soybean oil with and without anti-oxidants. They seem to also have less change in viscosity (means more stable) than the HOSO oil with and without anti-oxidants. The anti-oxidants used in all these tests were the same (5000 ppm TBHQ).

Ultimately, the oil/compound of the current invention can be modified to show a pour point of −30 C or lower and an oxidation stability that would match or surpass those of high oleic sunflower or high oleic canola oils. Therefore the HOSO oil of the current invention is useful as a premium base oil for industrial lubricants.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained. All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. More specifically, it will be apparent that certain agents which are both chemically and physiologically related may be substituted for the agents described herein while the same or similar results would be achieved. All such similar substitutes and modifications apparent to those skilled in the art are deemed to be within the spirit, scope and concept of the invention as defined by the appended claims.

As various changes could be made in the above particles and processes without departing from the scope of the invention, it is intended that all matter contained in the above description and shown in the accompanying drawings shall be interpreted as illustrative and not in a limiting sense. Each of the publications and patent applications cited in this specification are herein incorporated by reference as if each individual publication or patent application was specifically and individually indicated to be incorporated by reference.

LITERATURE CITED AND INCORPORATED BY REFERENCE

These references are specifically incorporated by reference relevant to the supplemental procedural or other details that they provide.

WO2009042770, —David A. Morgenstern et al., POLYUNSATURATED FATTY ACIDS IN PLASTICS AND SURFACE COATINGS (published Apr. 2, 2009)

Biobased Lubricants and Greases: Technology and Products, Lou Honary, (Erwin Richter, Wiley publishers) page 30-32.

Gelvin et al., Plant Molecular Biology Manual, (Kluwer Academic Publ. (1990)).

Jaworski, "*Industrial Oils From Transgenic Plants*", Current Opinion in Plant Biology, 2003, pp. 178-184, vol. 6.

Kinney et al., "*Designer Oils: The High Oleic Acid Soybean*", Genetic Modification in the Food Industry, pp. 193-213, 1998.

Weissbach and Weissbach, Methods for Plant Molecular Biology, (Academic Press, (1989)).

"*Demand for Synthetic Lubricants on the Rise*," Chemical & Engineering News (Sep. 7, 1998, p. 22), Engine lubricant additives comprising overbased sulfonates and jojoba oil are disclosed, for example and as reference: U.S. Pat. Nos. 4,557,841; 4,664,821; 4,668,413; and 5,505,867

U.S. Pat. No. 6,532,918 Mang, et al. Mar. 18, 2003

The invention claimed is:

1. A biodegradable liquid lubricant composition consisting of a wax, a petroleum base oil, and a high oleic acid transgenic soybean oil wherein the oleic acid composition of said oil is at least 45%.

2. The lubricant composition of claim 1, wherein the transgenic high oleic soybean oil contains from about 65 wt. % to about 80 wt. % of oleic acid.

3. The lubricant composition of claim 1, wherein the transgenic high oleic soybean oil comprises from about 80 wt. % to about 85 wt. % of oleic acid.

4. The lubricant composition of claim 1 wherein the petroleum base oil is a blend of polyalphaolefin and 1-decene.

5. The lubricant composition of claim 1 comprising a petroleum base oil of polyalphaolefin.

6. A gasoline composition comprising the lubricant composition of claim 1 and gasoline.

7. The gasoline composition of claim 6 wherein the lubricant composition and gasoline are premixed and packaged.

8. The gasoline composition of claim 7 wherein the gasoline and lubricant composition are packaged in a ratio of about 50 to 1 by volume or more.

* * * * *